United States Patent [19]

Driggers et al.

[11] Patent Number: 4,966,062

[45] Date of Patent: Oct. 30, 1990

[54] GUITAR SUPPORT APPARATUS

[76] Inventors: Robert H. Driggers, 302 Covewood Trial, Asheville, N.C. 28805; David E. Stevenson, Box 8814, Asheville, N.C. 28814

[21] Appl. No.: 477,718

[22] Filed: Feb. 9, 1990

[51] Int. Cl.[5] ..... G10G 5/00

[52] U.S. Cl. ..... 84/327; 224/910

[58] Field of Search ..... 84/327, 421, 453; 224/910

[56] References Cited

U.S. PATENT DOCUMENTS

| | | | |
|---|---|---|---|
| 1,261,841 | 4/1918 | Mortensen | 84/327 |
| 1,708,285 | 4/1929 | Truett et al. | 84/327 |
| 1,802,236 | 4/1931 | Carroll et al. | 84/327 |
| 1,945,162 | 1/1934 | Rasmussen | 84/327 |
| 2,547,924 | 4/1951 | Citro . | |
| 2,664,777 | 1/1954 | Kopa | 84/376 |
| 2,814,229 | 11/1957 | Vaccaro et al. | 84/327 |
| 3,958,786 | 5/1976 | Mann . | |
| 4,036,462 | 7/1977 | Sheftel . | |
| 4,037,815 | 7/1977 | Delano . | |
| 4,099,441 | 7/1978 | Landon | 84/327 |
| 4,274,181 | 6/1981 | Schaller . | |
| 4,582,282 | 4/1986 | Gracie | 84/327 X |
| 4,691,610 | 9/1987 | Gilbert . | |
| 4,742,751 | 5/1988 | Cherry . | |
| 4,770,079 | 9/1988 | Mastroianni | 84/291 |

*Primary Examiner*—Lawrence R. Franklin

*Attorney, Agent, or Firm*—Bailey & Hardaway

[57] ABSTRACT

A guitar support apparatus which supports a guitar in the playing position while the guitarist is in the sitting position, consisting of a leg support strap supporting three legs hinged together and having guitar support means opposite the strap.

3 Claims, 3 Drawing Sheets

GUITAR SUPPORT APPARATUS

BACKGROUND OF THE INVENTION

This invention relates generally to the art of music and more particularly to an apparatus for supporting a guitar when the guitarist is in the sitting position.

Various apparatuses have been provided for assisting a guitarist during the process of performing.

U.S. Pat. No. 2,547,924 to Citro discloses a stationary guitar support apparatus.

U.S. Pat. No. 4,037,815 to DeLano discloses a wall mounting bracket for supporting a guitar.

U.S. Pat. No. 4,274,181 to Schaller discloses a releasable strap coupling for a guitar.

U.S. Pat. No. 4,691,610 to Gilbert discloses a guitar stand as does U.S. Pat. No. 4,742,751 to Cherry.

U.S. Pat. No. 3,958,786 to Mann discloses a multipurpose instrument support apparatus as does U.S. Pat. No. 4,036,462 to Sheftel.

While a variety of guitar support apparatuses have been provided, there has not been a support apparatus provided for use while the guitarist is in the sitting position.

SUMMARY OF THE INVENTION

It is thus an object of this invention to provide a novel guitar support apparatus.

It is a further and more particular object of this invention to provide a novel guitar support apparatus for use while the guitarist is in the sitting position.

These, as well as other objects, are accomplished by a guitar support apparatus which has a leg support strap supporting three legs hinged together and having guitar support means opposite the strap.

DETAILED DESCRIPTION

In accordance with this invention, it has been found that a guitar support apparatus may be provided which is light, compact, collapsible and usable by a guitarist to support a guitar in a sitting position. Various other advantages and features will become apparent from a reading of the following description given with reference to the various figures of drawings.

Figure 1:
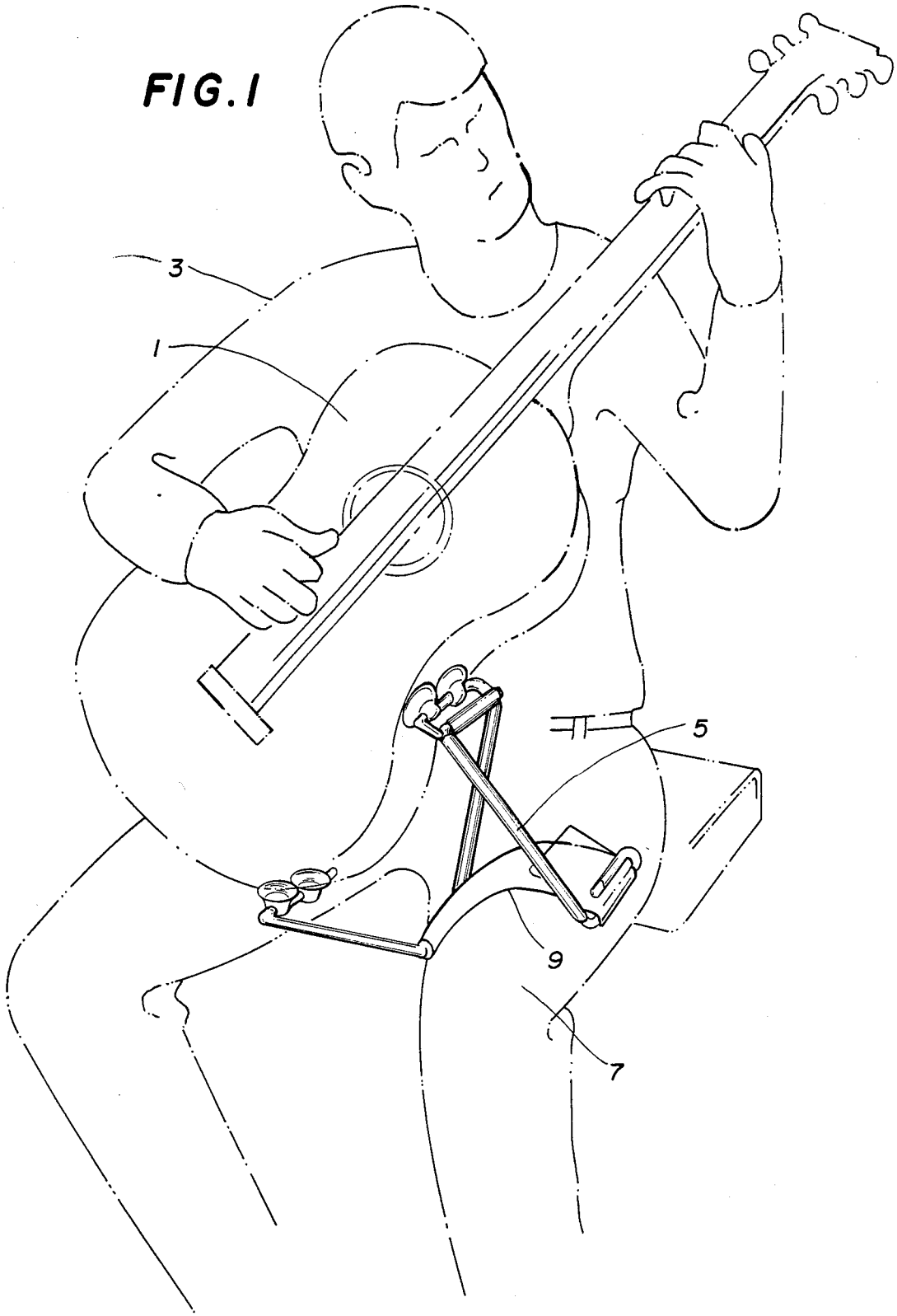
FIG. 1 of the drawings is the prospective view of a guitarist utilizing a guitar support apparatus in accordance with this invention.

FIG. 1 of the drawings illustrates a guitar 1 utilized by a guitarist 3 and supported by the guitar support apparatus 5 of this invention. It is seen that the apparatus 5 is supported on the guitarist's leg 7 by an adjustable strap 9. The apparatus 5 will be further described with reference to FIG. 2 of the drawings. It is seen that the apparatus 5 is formed of three (3) legs 11, 12 and 13; each leg has transverse extensions formed at either end thereof which are generally parallel to the opposing transverse leg. Thus, leg 11 has a first transverse extension 10, a second transverse extension 20. Leg 12 has a third transverse extension 30 and a fourth transverse extension 40. Leg 13 has a fifth transverse extension 50 and a sixth transverse extension 60.

Leg 11 is hinged to leg 12 by a first hinge 61 which joins extensions 20 and 30 therein. Leg 12 is hinged to leg 13 by a second hinge 62 which joins extensions 40 and 50 therein.

First hinge 61 is connected to extension 60 by an adjustable strap 9 which includes velcro 71 thereon to assist in adjusting the length of the strap 9 which contacts the user's leg 7.

Guitar contacting means 75 and 77 are illustrated herein. The mounting of contacting means 75 is clearly illustrated in FIG. 2 while FIG. 3 illustrates contacting means 77 as they are supported within hinge 62 and supported by legs 12 and 13.

Figure 2:
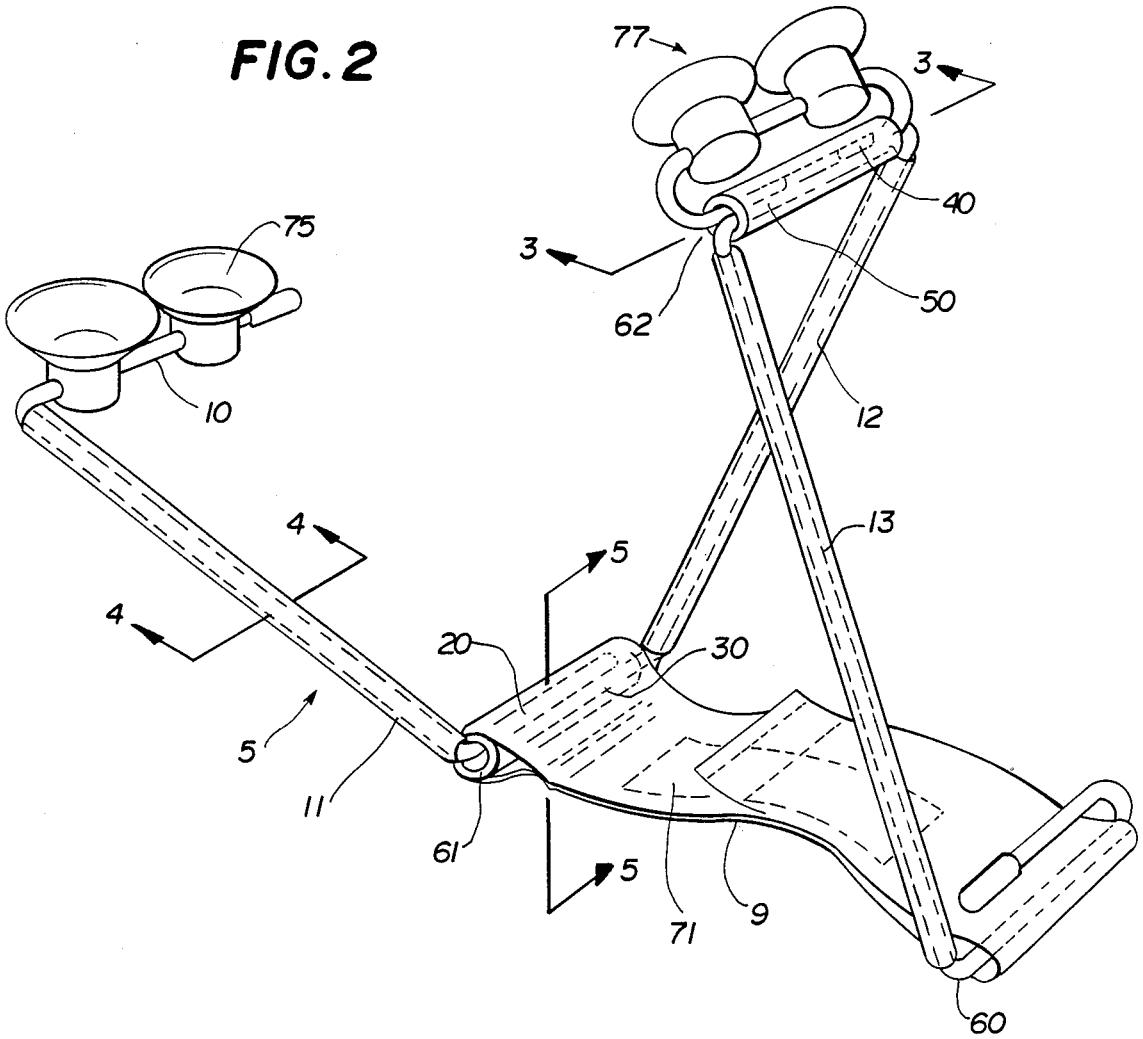
FIG. 2 of the drawings is a prospective view of the guitar support apparatus in accordance with this invention.
Figure 3:
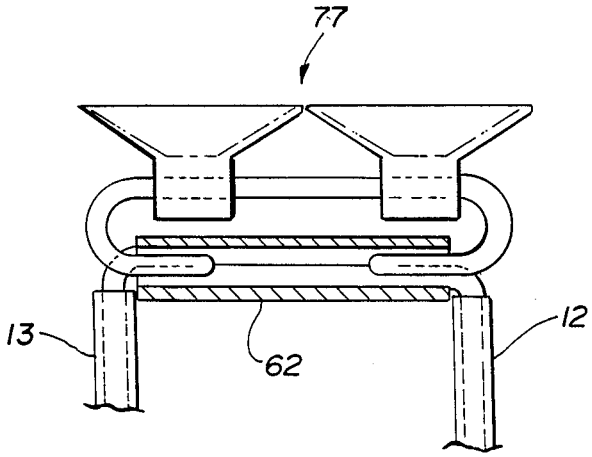
FIG. 3 of the drawings is an enlarged side view of the guitar contacting means in accordance with this invention.
Figure 5:
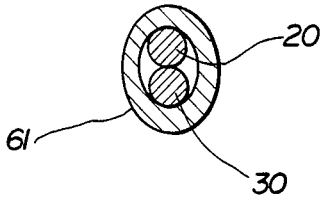
FIG. 5 of the drawings is a cross-sectional view along line 5—5 of FIG. 2.

FIG. 5 of the drawings is a view along line 5—5 of FIG. 2 and shows through hinge 61 showing extensions 20 and 30 within the hinge 61.

Figure 4:
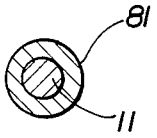
FIG. 4 of the drawings is a cross-sectional view along line 4—4 of FIG. 2.

FIG. 4 of the drawings is a view along line 4—4 of FIG. 2 and illustrates a preferred embodiment wherein leg 11 has a rubberized coating 81 thereon as do legs 12 and 13.

Such a rubberized coating could also be utilized for contacting a guitar; however, it is preferred that the guitar contacting means 75 and 77 be pairs of suction cups so as to be attachable to a guitar so that once a user has a preferred orientation, the support apparatus may be affixed to maintain that orientation.

It is thus seen that the apparatus of this invention provides a novel guitar support apparatus and one which is usable by a guitarist while in the sitting position. As many variations will become apparent to those who are skilled in the art from a reading of the foregoing descriptions, such variations are embodied within the spirit and scope of this invention as defined by the following appended claims.

That which is claimed is:

1. A guitar support apparatus comprising:

a first leg having a first transverse extension at one end thereof and a second transverse extension parallel to said first transverse extension at the other end thereof;

a second leg having a third transverse extension at one end thereof and a fourth transverse extension parallel to said third transverse extension at the other end thereof;

a third leg having a fifth transverse extension at one end thereof and sixth transverse extension parallel to said fifth transverse extension at the other end thereof;

a first hinge joining said first leg and said second leg together by said second and third extension;

a second hinge joining said second leg to said third leg by said fourth and fifth transverse extensions;

an adjustable leg support strap connecting said first hinge and said sixth transverse extension; and guitar contacting means on said first transverse extension and said second hinge.

2. The apparatus according to claim 1 wherein said guitar contacting means are suction cups.

3. The apparatus according to claim 1 wherein said adjustable strap has velcro on one side thereof for adjustment.

* * * * *